United States Patent [19]

Choderker et al.

[11] Patent Number: 4,544,058

[45] Date of Patent: Oct. 1, 1985

[54] COIN ACCEPTOR

[76] Inventors: Nathan Choderker, 1880 S. Ocean Dr., Hallandale, Fla. 33009; Carl E. Dorman, 7155 W. 14th Ct., Hialeah, Fla. 33014; Ian Richter, 906 Nautilus Isle St., Dania, Fla. 33004; Richard Driver, 2997 Newfound Harbor Dr., Merritt Island, Fla. 32952

[21] Appl. No.: 596,708

[22] Filed: Apr. 4, 1984

[51] Int. Cl.[4] ..... G07D 5/02

[52] U.S. Cl. ..... 194/102; 194/103

[58] Field of Search ..... 194/99, 101, 102, 103

[56] References Cited

U.S. PATENT DOCUMENTS

| | | | |
|---|---|---|---|
| 1,852,725 | 4/1932 | Ross | 194/101 X |
| 2,580,906 | 1/1952 | Frost | 194/103 X |
| 2,770,343 | 11/1956 | Andrews et al. | 194/102 |
| 3,237,631 | 3/1966 | Mikiokamei et al. | 194/102 X |
| 4,098,387 | 7/1978 | Martin | 194/102 |

*Primary Examiner*—F. J. Bartuska

*Attorney, Agent, or Firm*—Jack E. Dominik

[57] ABSTRACT

This invention relates to testing a coin by catching the coin, while it is moving, between a varying radius cam and a pin on a low inertia carrier. The carrier axle is in a fixed relationship to the cam. The coin's momentum plus weight turn the carrier until an end travel point is reached and momentum causes the coin to depart the carrier and go into an accept outlet. Additionally, magnetic fields passing through the coin's path provide further forces on the coin which help pull magnetic coins off the carrier into the reject outlet prior to the end travel point being reached. Undersize or underweight coins leave the carrier early and divert to reject. Oversize coins complete full travel, but cannot pass through to the accept outlet, and move back to reject outlet. Also, stringing of acceptable coins for retrieval is defeated by a trip in the accept outlet. Blockage of the reject outlet is defeated by a lever to stop rotation of the carrier in conjunction with a pin on the carrier to block spillover coins. By varying the proportions of the carrier and cam, the acceptor can operate with various preselected coins.

6 Claims, 28 Drawing Figures

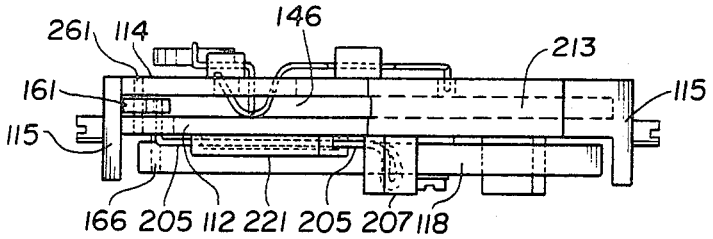
FIG.10C
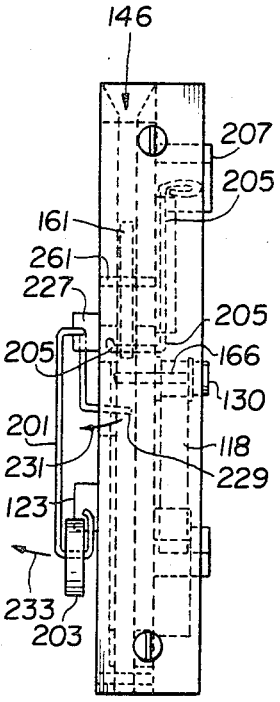
FIG.10E
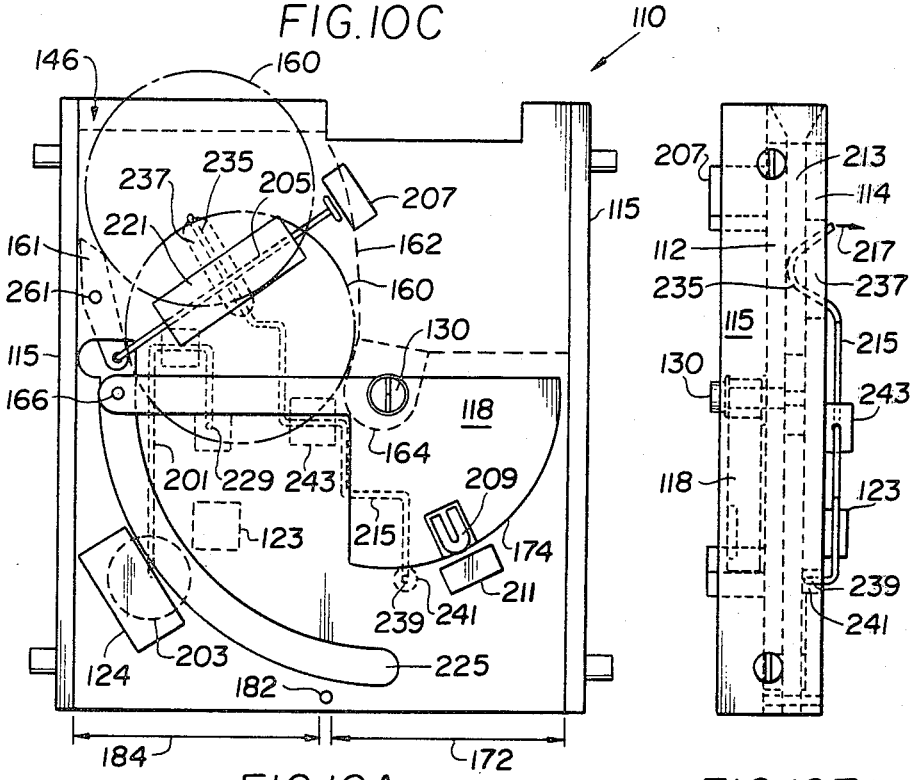
FIG.10A
FIG.10F
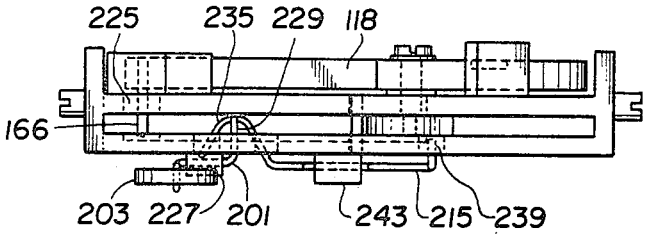
FIG.10D

COIN ACCEPTOR

Background of the Invention

1. Field of Invention.

The invention relates to a coin testing apparatus which accepts validated coins and rejects unwanted objects. The subject coin acceptor is useful in vending machines, amusement games, and other coin-activated machines such as washers, dryers, and telephones.

2. Description of the Prior Art.

Coin operated vending machines and amusement games have become increasingly popular in recent years with the number of units as well as the types of merchandise dispensed and video games available, increasing at a rapid rate. Most of these machines are operated by the customer either depositing coins of preselected value in the machine, or in the alternative, inserting tokens followed by manual operation of selector buttons, levers or similar mechanisms. Because of the fact that the machines are many times located in unattended areas and furthermore because of the fact that constant surveillance is not maintained over the machines, attempts have been made to obtain products, games, or services from the machines without deposit of genuine coins or tokens. Counterfeit coins, foreign coins, slugs, metallic discs and other similar objects have been used in efforts to actuate the machine and for this reason, complex and highly refined coin selecting apparatus has been developed over a period of years, for separating spurious coins from genuine coins regardless of the type of counterfeit or foreign coin which is deposited in the machine. The coin selecting units have conventionally employed various means for testing the authenticity of the coin as to size, weight and materials from which the objects are made. Some difficulty has heretofore been experienced with respect to detecting slugs or discs of slightly smaller or larger than the proper diameter and which have physical properties very similar to that of a genuine coin.

In the known coin acceptors the following features are tested by the following means and methods:

(A) weight and diameter (undersize) by a balance;

(B) the diameter (oversize) at a limiting lever;

(C) washers or the like by a ring catcher;

(D) iron content, magnetism and electric conductivity of the coin by a magnet;

(E) thickness and possible deformation in a channel limited by the magnet; and (F) hardness and elasticity by an anvil. The entire testing procedure in the known coin testers runs as follows:

(1) The coins inserted normally arrive at first on a so-called coin balance by which their diameter and weight are tested.

(2) Coins or discs having a somewhat smaller diameter than an acceptable coin fall through the coin balance directly into the coin return channel.

(3) Coins or discs of lighter weight than an acceptable coin do not move the coin balance.

(4) Coins or discs with larger diameters are retained by a limiting lever blocking their passage thus requiring manual operation to reject the spurious coin.

(5) Bored discs are collected by an annulus catcher thus blocking further passage and also requiring manual rejection. All coins or discs stopped in the coin accepter are normally delivered into the coin return channel by manual actuation of a coin rejector.

Coins having approximately the correct diameter and sufficient weight turn the coin balance and roll out of it via an inclined running path. They then arrive at a channel limited by a magnet, in which thicker, distorted or magnetic discs or coins are retained. These retained coins or discs may be stripped off by a wiper blade or scavenger and delivered into the coin return channel by actuation of the opening or scavenging lever.

All the coins or discs passing the magnetic field are checked for their electric conductivity by means of the eddy-currents induced therein by the magnetic field. Because of the eddy-current braking the coins leave the magnetic field at a speed dependent on their electric conductivity. Coins leaving the magnetic field at a sufficient high speed impinge upon an anvil rebound therefrom, and fall into the channel for acceptable coins. Coins or discs which higher electric conductivity are braked in a higher degree by the eddy-currents induced therein. There normally include bronze, brass and copper discs and coins as well as silver coins. The coins or discs impinging upon the anvil rebound therefrom with a speed depending on the hardness and elasticity thereof. In this way lead discs, for instance, may be eliminated which, although fully impinging upon the anvil, leave it at such a low speed that they no longer drop into the channel for acceptable coins.

Many coin selecting apparatus utilize as a balance a cradle structure pivotally mounted substantially in the zone of juncture of a coin selecting pathway therebeneath, and a coin accepting pathway adjacent the coin rejecting pathway. The cradle is provided with spaced projections thereon adapted to support a coin of a particular dimensions so that the cradle is pivoted about the axis of rotation thereof to divert the coin into the coin accepting pathway. the spaced projections on the cradle structure, however, are sufficiently spaced to pass therethrough coins of other dimensions which have smaller diameters. The coins passing between the cradle projections are directed into the coin rejecting pathway. Thus the cradle principle is suitable for separating coins or discs having relatively wide diameter differences such as nickels, dimes and quarters. On the other hand such cradles are not capable of being utilized to separate coins or discs of slightly smaller than the required diameter. The spacing between the cradle projections has not proved satisfactory as a means for rejecting slugs or discs of a slightly smaller diameter than a proper coin. The reason is that the slightly smaller coin has a tendency to become wedged between the cradle projections and could not be cleared from the mechanism upon operation of the scavenger. Consequently, the cradle projections are purposely designed to be spaced very appreciably closer than the minimum diameter of the particular denomination of coin to be normally supported therebetween. It is basic that the center of gravity of a coin carried by the cradle projections is to one side of the axis of rotation of the cradle so that the latter will be rotated in a manner to divert the coin on the projections, into the coin accepting pathway.

Further, various methods of cheating are routinely practiced which include (1) tying a string to an acceptable coin in order to retrieve the coin after it has passed the tests and (2) inserting a sequence of unacceptable coins while blocking the outlet for such coins so that the coins will back up in the mechanism and fall over into the acceptable coins outlet and thereby activate the coin operated machine.

The prior art has required a means to mechanical scavage coins or slugs which have become jammed in the coin mechanism. The customer must then actuate a lever or push button to return these jammed coins. Quite often this actuator breaks or becomes jammed and thus creates costly service calls and loss of revenue. The down time and cost of service favor a jam free acceptor which does not comprise accuracy to achieve its jam free operation.

SUMMARY OF THE INVENTION

The present invention tests a coin by catching the coin, while it is moving, between a varying radius cam and a pin on a low inertia carrier. The carrier axle is in a fixed relationship to the cam. The coin's momentum plus weight turn the carrier until an end travel point is reached and momentum pulls the coin off of the carrier into an accept outlet. Additionally, magnetic fields passing through the coin's path provides further forces on the coin which help pull magnetic coins off the carrier into the reject outlet prior to the end travel point being reached. Undersize or underweight coins leave the carrier early and divert to reject. Oversize coins complete full travel, but cannot pass through to the accept outlet, and move back to reject outlet. Also, stringing of acceptable coins for retrieval is defeated by a trip in the accept outlet. Blockage of the reject outlet is defeated by a lever to stop rotation of the carrier in conjunction with a pin on the carrier to block spillover coins. By varying the proportions of the carrier and cam, the acceptor can operate with various preselected coins. The present invention does not require any user actuators, thus eliminating costly service calls. The elimination of the requirement of mechanical actuator is also a significant cost savings to the manufacturer.

BRIEF DESCRIPTION OF THE DRAWINGS

FIGS. 10A–F show a second preferred embodiment.

Detailed Description of a First Preferred Embodiment

Figure 1A:
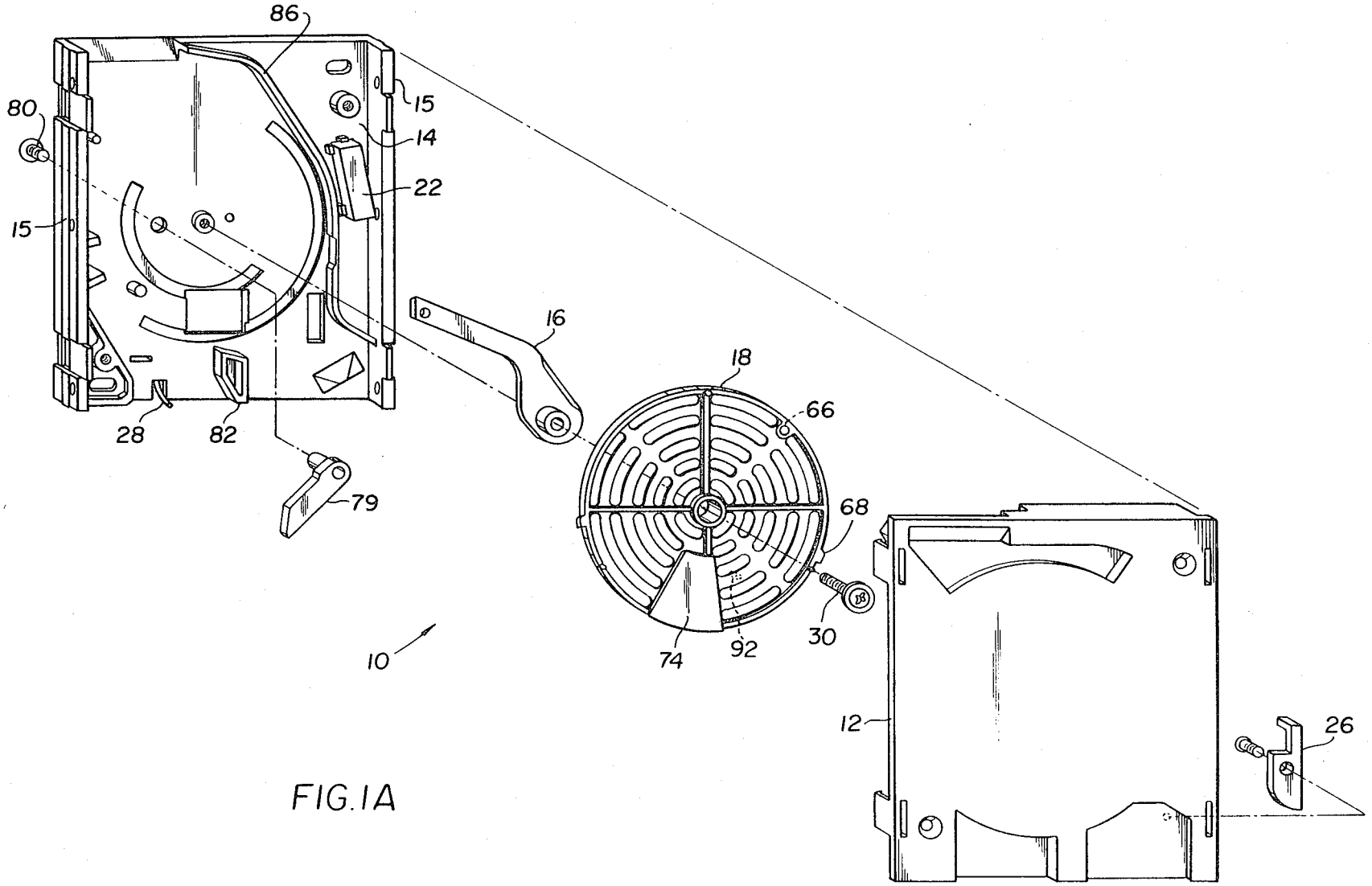
FIGS. 1A and 1B show a first preferred embodiment of the inventive apparatus in exploded cabinet front and rear views, respectively.
Figure 1B:
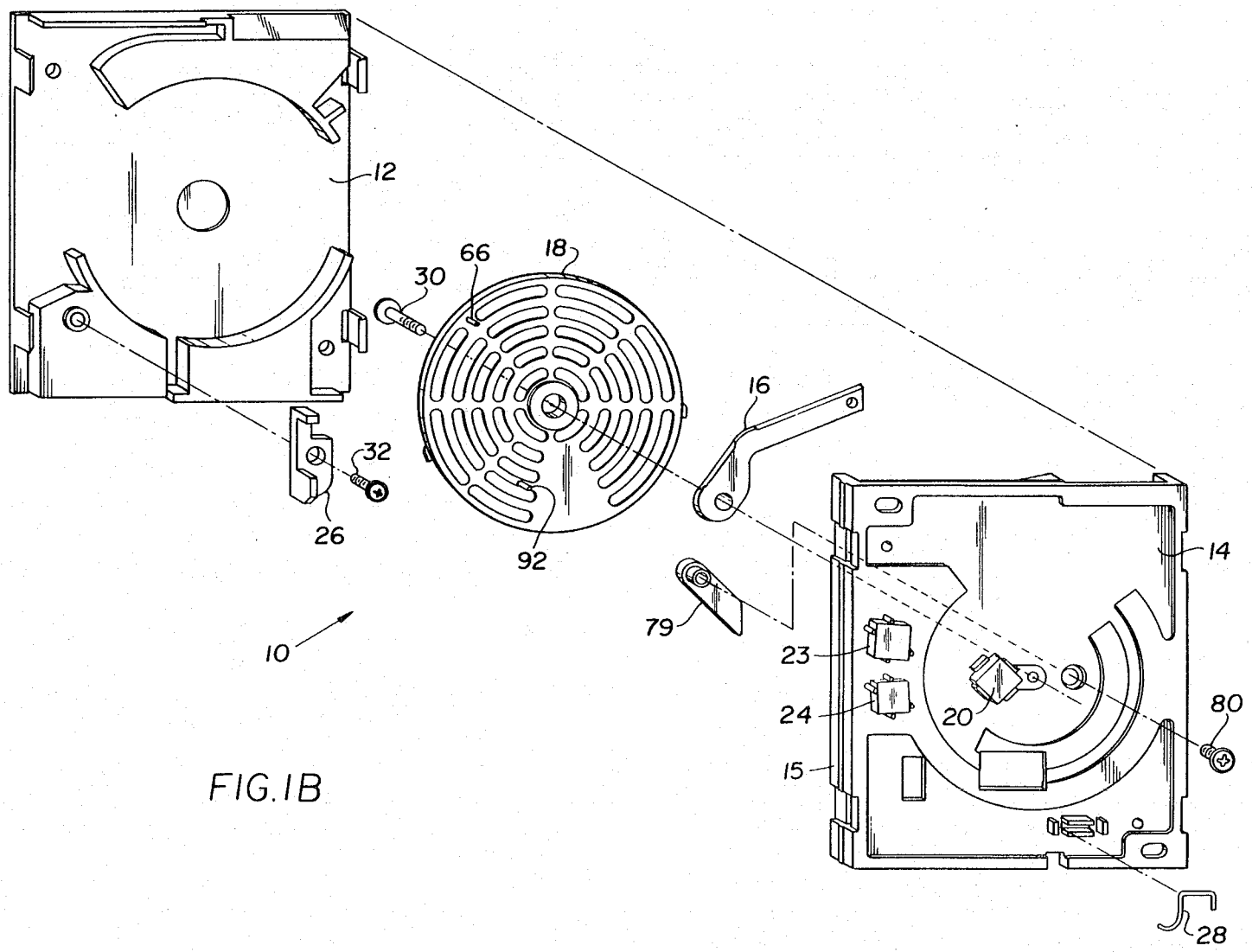

FIGS. 1A and 1B illustrate in exploded cabinet views, front and back, a first preferred embodiment of the inventive coin testing apparatus 10 for testing coins which purport to be U.S. twenty-five cent pieces (quarters). Apparatus 10 is approximately $3\frac{1}{2}\times4\times9/16$ inches and includes a front plate 12, back plate 14 with side walls 15, coin race-cam 16, a carrier in the form of a weighted wheel 18, magnet 20, magnet 22, magnet 23, magnet 24, small coin lever 26, stringing wire 28, and screws 30, 32, and coin catching pin 66. Front plate 12 and back plate 14 are made of Lexan and race-cam 16 and wheel 18 are made of Celcon. Lexan provides unbreakability and low friction, and Celcon provides self lubrication.

Figure 2:
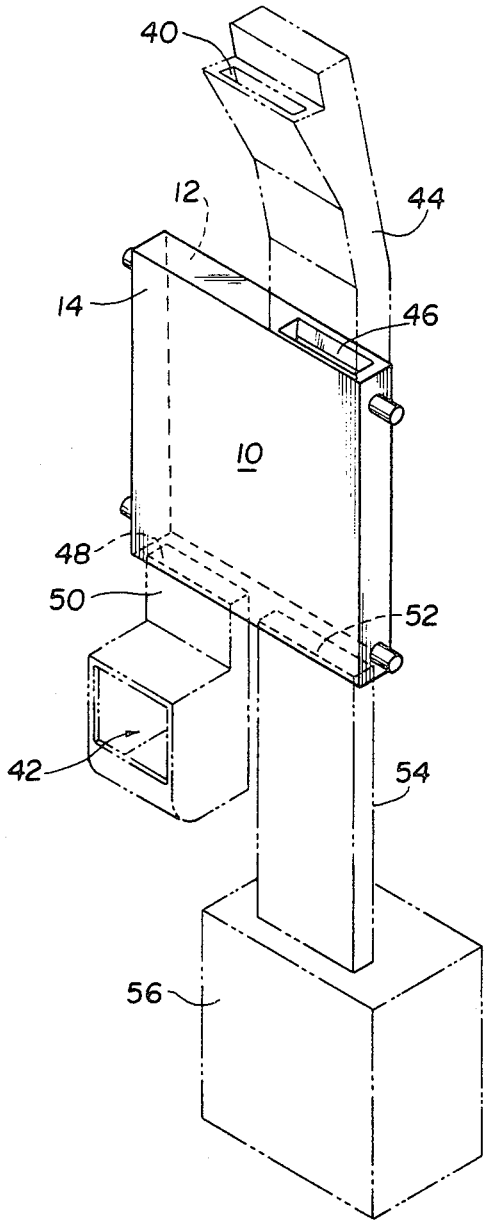
FIG. 2 shows the first preferred embodiment as frequently mounted in a vending machine.

As shown in FIG. 2, apparatus 10 is normally mounted within a coin operated machine below a coin inlet 40 and above a rejected coin outlet 42. Upon insertion into inlet 40 a coin falls down chute 44, gaining kinetic energy, and enters apparatus 10 through inlet 46, which is formed as a gap between front plate 12 and back plate 14. As described below, the energy picked up by the coin falling down chute 44 activates apparatus 10. Coins rejected by apparatus 10 emerge from outlet 48 and fall down chute 50 to rejected coin outlet 42. Coins accepted by apparatus 10 emerge from outlet 52 and fall down chute 54 into deposit box 56. Outlets 48 and 52 formed as gaps between front plate 12 and back plate 14. The height and width of inlet 40 provide upper limits on the diameter and thickness of coins which will be tested by apparatus 10. Typically inlet 40 has a length and width slightly more than the size of the intended coin to reject oversize coins at the outset.

Figure 3A:
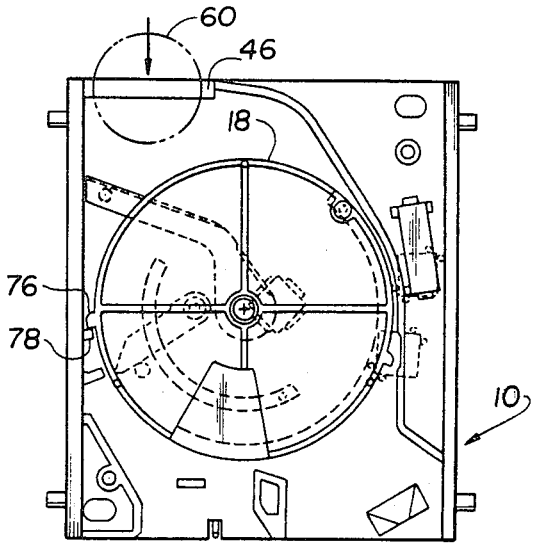
FIGS. 3A–3H show the sequence of events for a genuine coin passing through the first preferred embodiment.
Figure 3B:
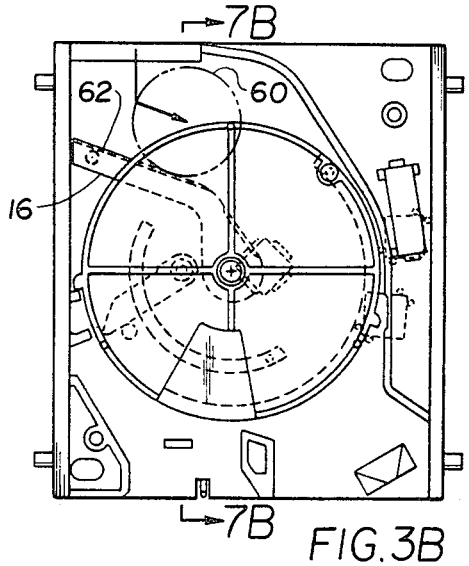
Figure 3C:
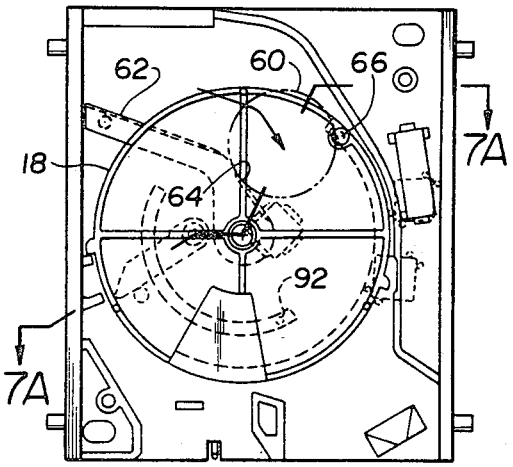
Figure 7A:
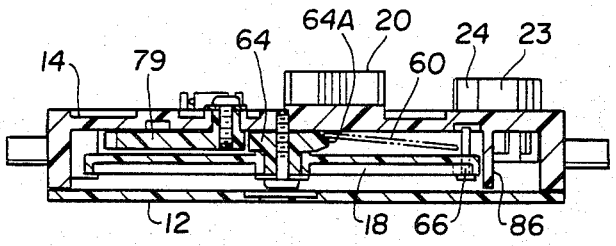
FIGS. 7A and 7B show cross-sectional views along line 7—7 of FIGS. 3C and 3B, respectively.
Figure 7B:
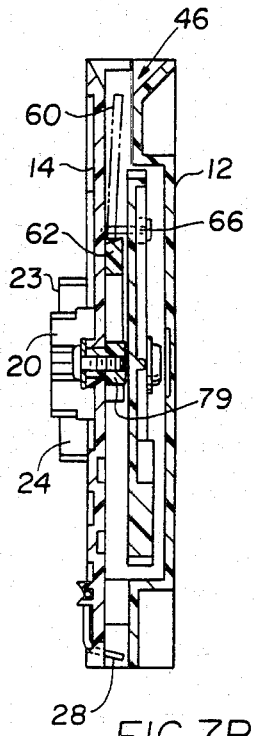

FIGS. 3A–3H show the operation of apparatus 10 when a genuine coin, quarter, here enters inlet 46. In more detail, coin 60 enters inlet 46 and begins its path of travel (FIG. 3A). Coin 60 strikes the upper portion 62 of race-cam 16 and is deflected to the right as shown in FIG. 3B. Coin 60 loses little of its kinetic energy as it moves down race portion 62. As shown in FIG. 7B race portion 62 is beveled so that any fluids poured into opening 46 will drain toward back plate 14 and leave any residue against back plate 14 whereas coin 60 will contact race portion 62 closer in front plate 12 but will be held against back plate 14 above such residue. As shown in FIG. 3C, after coin 60 has moved down race portion 62 it rolls on cam portion 64 until it engages pin 66 mounted on wheel 18. The distance from pin 66 to the closest point of cam portion 64 is about 0.875 inches. This compares with the diameter of a quarter of approximately 0.952 inches. These dimensions serve to illustrate the relative distances which are employed.

Figure 3D:
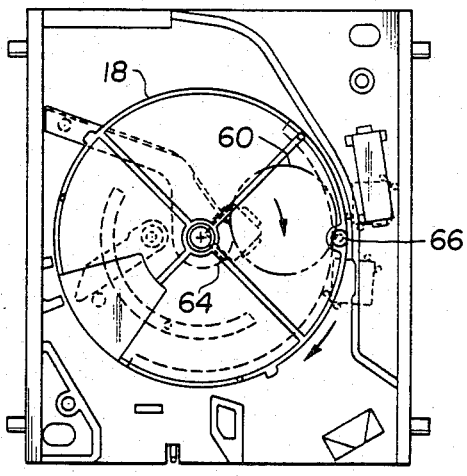

As shown in FIG. 3D, upon striking pin 66 coin 60 transfers a portion of its kinetic energy to wheel 18, and the coin 60/wheel 18 combination rotates with coin 60 held by pin 66 and sliding on cam portion 64. Presuming conservation of kinetic energy, the speed of coin 60 while engaging wheel 18, as in FIG. 3D, is approximately the initial speed of coin 60 just prior to contact with pin 66 multiplied by the factor $$(2m/(3m+4M))^{\frac{1}{2}}$$

where m is the mass of coin 60 and M is the mass of wheel 18. Wheel 18 weighs about 6 grams, which is comparable to a quarter's weight of 5.6 grams. Gravity is also acting on coin 60 throughout its downward descent and further adds to its speed; however, coin 60 cannot start at rest on wheel 18 and turn it by gravity alone without a chance of falling forward off of pin 66 as described below for the case of coin 60 being much lighter than a quarter. Rather the initial speed of coin 60 upon impact with pin 66 is the major source of energy for transfer to wheel 18. Also, the multiplicative factor indicates the importance of keeping the mass of wheel 18 low compared to the mass of coin 60 if the speed of coin 60 is not to be greatly reduced.

The shape of cam portion 64 permits it to detect the diameter of coin 60 as described below. Cam portion 64 is shown enlarged in FIG. 3I and includes a first straight portion 64A plus a curved portion 64B which has a continuously decreasing radius in the clockwise direction as measured from wheel 18 rotation axis 65.

Figure 3G:
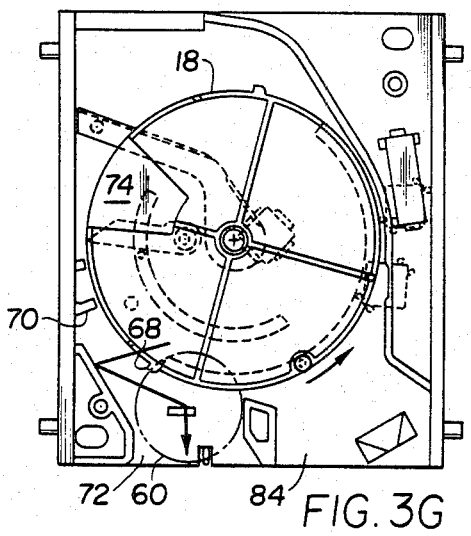
Figure 3E:
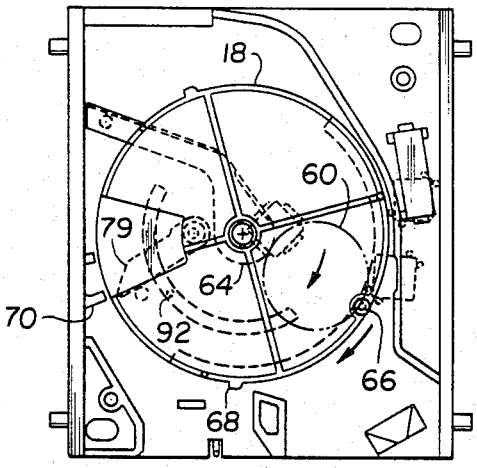
Figure 3H:
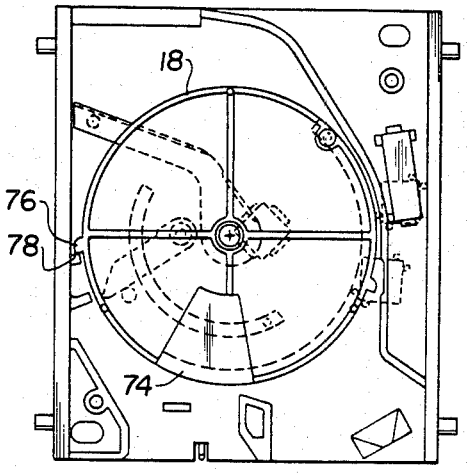
Figure 3F:
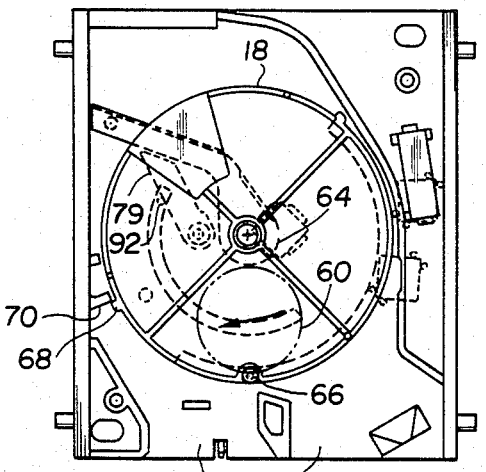
Figure 3I:
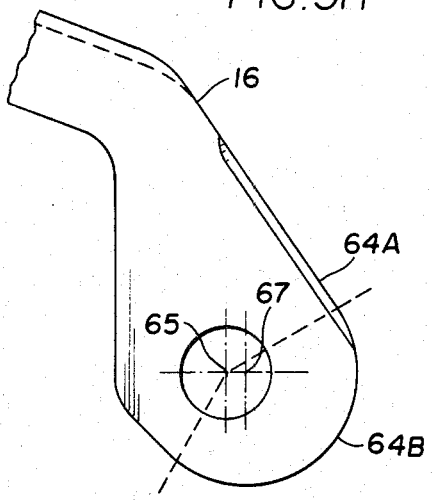
FIG. 3I shows a plan view of the cam.

Straight portion 64A is beveled, as indicated in FIG. 3I and shown in cross-section in FIG. 7A, to cause very thin coin 60 to tilt and thereby present an effective diameter less than their actual diameter and be rejected as an under diameter coin; see discussion in connection with FIGS. 6A–6B below.

The radius of curved portion 64B varies from about 0.290 inches at the 2 o'clock position (junction of 64A and 64B) to about 0.235 inches of the 7 o'clock position. Curved portion 64B may be conveniently fabricated by using a 0.250 inch radius piece where the radius is measured from a point 0.040 inches to the right of axis 65 and shown as point 67 in FIG. 3I. Now the distance from axis 65 to the closest point on pin 66 is about 1.228 inches, so coin 60 with a diameter of 0.952 inches (a typical quarter's diameter) will just fit between cam portion 64 and pin 66 when pin 66 is in about the 4 o'clock position as shown in FIG. 3E. However, coin 60 does not fall forward on pin 66 quickly enough to significantly alter its path because of the high speed of rotation and consequent little time for gravity to act.

As shown in 3F, wheel 18 continues turning until stop 68 on wheel 18 contacts detection stop 70 on back plate 14. At this point the distance between pin 66 and cam portion 64 is slightly greater than the diameter of a quarter, and the momentum of coin 60 carries it past the stopped pin 66 which is in about the 6 o'clock position as indicated by the arrow in FIG. 3F. Indeed, coin 60 flies off of wheel 18 and, as shown in FIG. 3G, rebounds off of the portion of back plate 14 forming the end walls of apparatus 10 (see FIG. 1) and leaves apparatus 10 through slot 72. Slot 72 is formed as a gap between front plate 12 and back plate 14.

Also as shown in FIG. 3G after wheel 18 has been stopped by the engagement of stop 68 with detection stop 70, counterweight 74 causes wheel 18 to rotate back to its initial position which, as shown in FIG. 3H, is determined by stop 76 on wheel 18 engaging return stop 78 on back plate 14. The time for wheel 18 to return to its starting position once coin 60 has fallen off is determined by the portion of its mass that is concentrated in counterweight 74. Thus, to minimize the return time, it is convenient to reduce the mass of the portion of wheel 18 other than counterweight 74 by eliminating material not necessary for structure, as shown in FIG. 1.

If coin 60 has a diameter greater than the cam 64—pin 66 distance in FIG. 3F, then coin 60 cannot go to the left and will fall off of pin 66 to the right and exit apparatus 10 through slot 84.

Figure 4A:
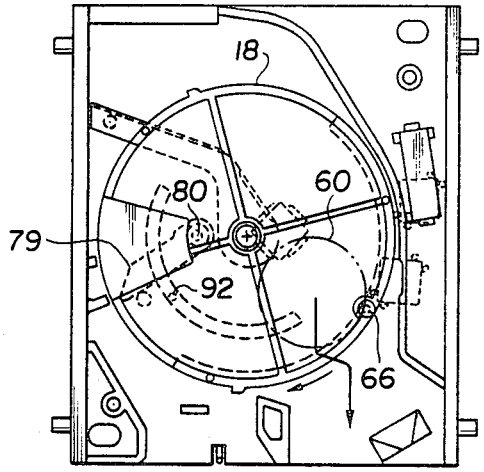
FIGS. 4A–4B show a partial sequence for an underweight coin.
Figure 4B:
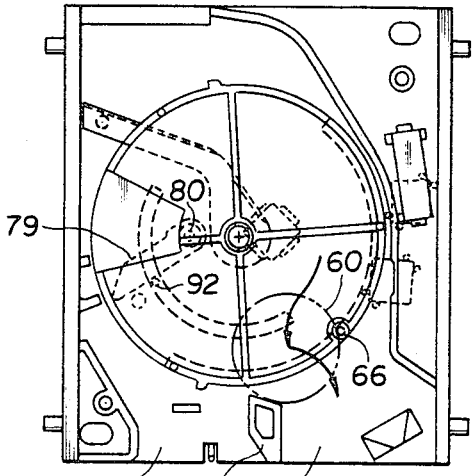

FIGS. 4A and 4B show how coin 60 is rejected if it is much lighter than a genuine quarter but of the same dimensions. In particular, the speed of coin 60 along wheel 18 depends upon the ratio of the mass of coin 60 to the mass of wheel 18 (as discussed in connection with FIGS. 3D and 3E). And if wheel 18 is turning slowly, then coin 60 will be greatly influenced by gravity which, once the 4 o'clock release position is reached, will cause it to fall forward, pivoting on pin 66 and to the left in FIG. 4B. Further, inertial brake 79 slows wheel 18 when approximately the 4:30 o'clock position is reached. Brake 79 is a weight held suspended on back plate 14 by screw 80 and which engages pin 92 on wheel 18. The use of brake 79 rather than just increasing the mass of wheel 18 to slow rotation has the advantage of allowing very light coin 60 still to be heavy enough to rotate wheel 18 to the release point, yet a somewhat heavier, but still light, coin 60 will have sufficient braking applied to wheel 18 by brake 79 to permit coin 60 time to fall forward on pin 66 and to outlet 84 as in FIG. 4B. Then coin 60 will be deflected by cavity separator 82 and leave apparatus 10 through outlet 84 rather than outlet 72.

Figure 5A:
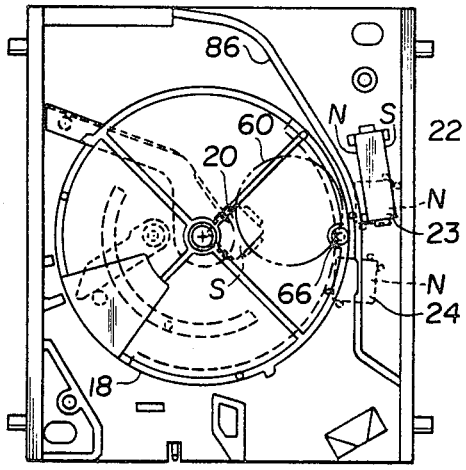
FIGS. 5A–5B show a partial sequence for a magnetic coin.
Figure 5B:
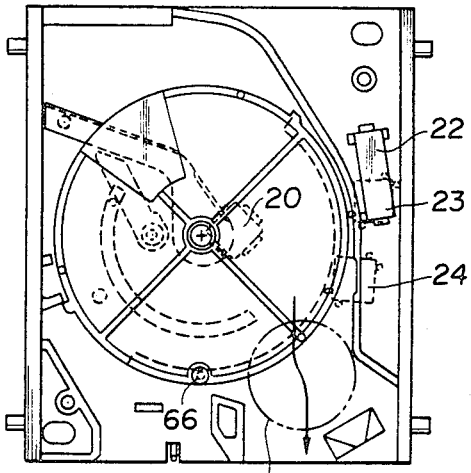

FIGS. 5A and 5B illustrate how magnets 20, 22, 23, and 24 pull iron (or other ferromagnetic) coin 60 backwards on pin 66 and off into outlet 84 as described in the following. The arrangement of the magnets is most easily understood by considering cross-sectional view FIG. 7A in conjunction with FIGS. 1A, 1B, 5A and 5B. Magnet 24 is oriented parallel to magnet 23. This arrangement provides sufficient field strength to pull heavy coin 60 (fast rotation) backwards on pin 66 yet insufficient field strength to cause light coin 60 to stick to the magnets. Magnetic isolation guide 86 insures that coin 60 will not approach too close to magnets 22, 23, or 24. Magnets 20, 23, and 24 are conveniently of square cross-section and field strength of about 3800 gauss. Magnet 22 is conveniently about the size of two magnets 20 (or 23 or 24) side-by-side and with the same field strength. If magnet 20 is increased in strength, then light coin 60 will rotate wheel 18 down to about 6 o'clock position and then rise to cam 64B and stick to magnet 20. Conversely, if magnet 20 is decreased in strength, then heavy coin 60 will not be sufficiently pulled backwards on pin 66 and will carry over to outlet 72. Similarly, if magnets 22, 23 or 24 are increased in strength, then light coin 60 will be pulled off pin 66 and stick at the 3 o'clock position; whereas, if magnets 22, 23 or 24 are decreased in strength, then heavy coin 60 will not be sufficiently pulled backwards and will carry to outlet 72.

Figure 6A:
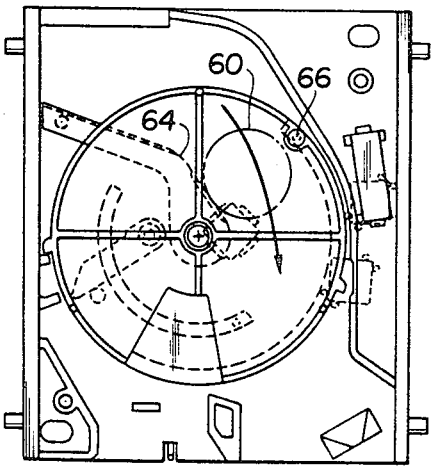
FIGS. 6A–6B show a partial sequence for an under diameter coin.
Figure 6B:
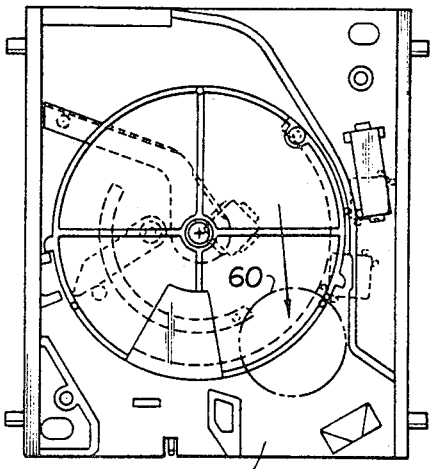

As shown in FIGS. 6A and 6B, if coin 60 has a diameter of less than 0.875 inches it will pass between pin 66 and cam portion 64 and fall directly down to reject outlet 84. Similarly, if coin 60 is thin, then it will slip on the bevel of straight portion 64A and tilt (see FIG. 7A) and, in effect, act as a smaller-diameter coin.

Figure 8:
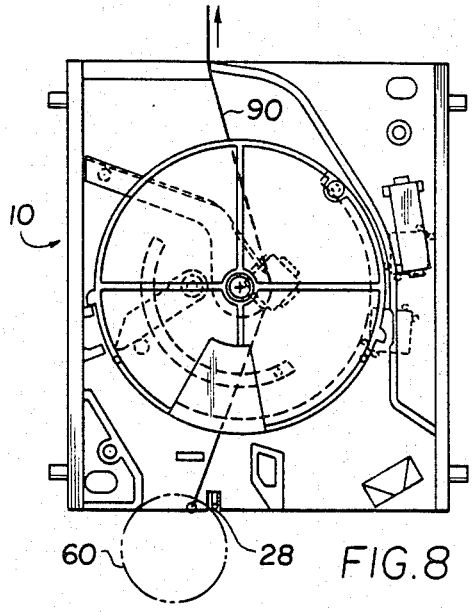
FIG. 8 shows an attempted retrieval of an accepted coin by means of a string.

As shown in FIG. 8, if a genuine quarter 60 is attached to a string 90 and passed through apparatus 10, then an attempt to retrieve quarter 60 by pulling on string 90 will be defeated by stringing wire 28 which blocks the path of a quarter moving upwards. Of course, a quarter 60 moving downwards will simply deflect stringing wire 28 and pass through.

Figure 9:
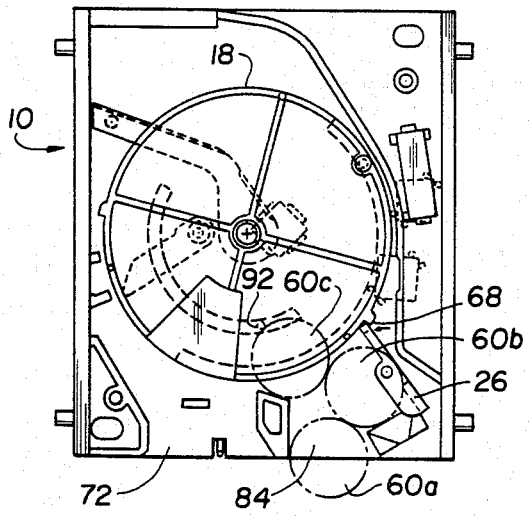
FIG. 9 shows an attempt to cause coin acceptance by blockage of the rejection outlet.
Figure 10B:
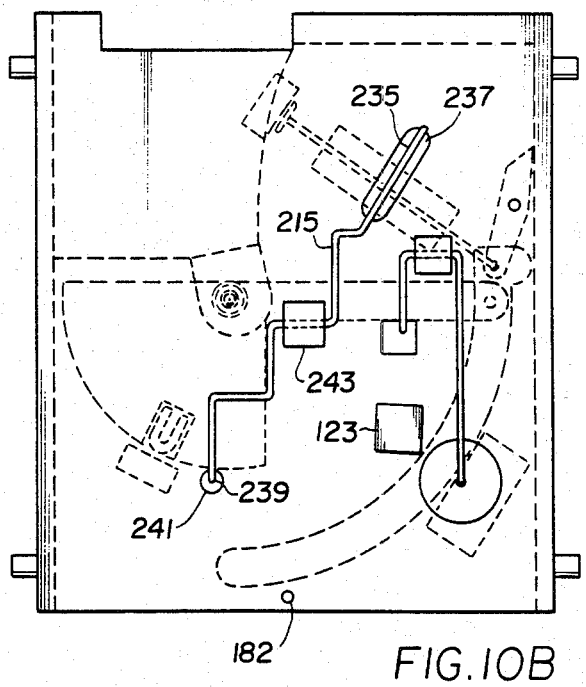

As shown in FIG. 9, attempts to defeat apparatus 10 by blocking outlet 84 followed by insertion of rejectable coins (such as pennies) in an attempt to cause the rejectable coins to spill over into outlet 72 is defeated by pin 92 on wheel 18 in conjunction with smaller coin lever 26 and stop 68 on wheel 18 as follows: Penny 60*b* deflects lever 26 so that wheel 18 cannot rotate more than a few degrees before stop 68 abuts lever 26. Then penny 60*c* is blocked by pin 92. Further, if additional pennies are inserted they merely continue backing up in apparatus 10 towards the inlet. Lastly, once the blockage of outlet 84 is released, pennies 60*a*, 60*b* and 60*c* merely exit apparatus 10 by outlet reject 84; no manual scavenging is required.

As illustrated in the foregoing description of apparatus 10, no manual scavenging or release is required, and the simplicity of design of apparatus 10 eliminates almost all jamming.

Second Preferred Embodiment

FIGS. 10A–F show a second preferred embodiment of the inventive apparatus, which is generally designated 110, in front, back, top, bottom, left, and right views, respectively. Apparatus 110 is typically used to accept Eisenhower silver dollars and reject slugs of the similar size; of course, varying the dimensions would then allow the acceptance of another size coin instead. Analogous to the first preferred embodiment apparatus 10, the second preferred embodiment apparatus 110 includes a front plate 112, a back plate 114, side walls 115, a carrier 118 (analog of wheel 18) including a pin 166 and counterweight 174, variable cam 164, magnets 123 and 124 and race 162. Apparatus 110 also includes annulus catcher 201 with weight 203, interior plate 213, deflector 161 with connecting rod 205 and magnet 207, ferrous block 209 and magnet 211, and synchronous coin lock out 215.

Apparatus 110 is essentially the same size as and basically operates in the same fashion as first preferred embodiment apparatus 10 in that acceptable coin 160 engages pin 166 and rotates carrier 118 about screw 130 while sliding on variable radius cam 164 until pin 166 reaches approximately the 6 o'clock position relative to screw 130 in FIG. 10A. At this point carrier 118 is stopped and coin 160 carries over into accept outlet 172. In contrast to first preferred embodiment apparatus 10, coin 160 does not roll down a race prior to engaging pin 166 and carrier 118 only rotates approximately 90° compared to wheel 18's approximate 135° rotation. This difference is basically due to the space limitations imposed by the larger size of an Eisenhower silver dollar as compared to a quarter.

In more detail, apparatus 110 operates as follows. Coin 160 (Eisenhower silver dollar or comparable size coin) enters inlet 146 which is formed as an about $\frac{1}{8}''$ gap between front plate 112 and back plate 114; interior plate 213 fills the space between front plate 112 and back plate 113 in approximately the upper right quarter of apparatus 110, as seen in FIG. 10A. Coin 160 falls and first deflects the upper end of lock out 215 in the direction of arrow 217 in FIG. 10F, the operation of lock out 215 will be detailed below. Lock out 215 presents virtually no resistance to the fall of coin 160, and coin 160 continues down to engage deflector 161, as shown by upper coin 160 in FIG. 10A. Deflector 161 is an approximately rectangular piece located between front plate 112 and back plate 114 and which is free to pivot on pin 261. Connecting rod 205, which is free to slide longitudinally in guide 221, is pivotally linked to the lower end of deflector 161. The upper end of connecting rod 205, made of ferrous material, is attracted by magnet 207, and this provides a restoring force on deflector 161, although this forces decreases as deflector 161 is deflected and connecting rod 205 moves away from magnet 207, whereas a spring force would increase. In FIG. 10A deflector 161 is in the undeflected position: connecting rod 205 is at its point of closest approach and greatest attraction to magnet 207, but it cannot approach any closer because the upper end of deflector 161 bears against left side wall 115.

Coin 160 just engages the upper end of deflector 161 and deflects to the right, as it falls, as shown by upper coin 160 in FIG. 10A. Coin 160 continues falling until it engages the lower end of deflector 161 and coin 164, as shown by lower coin 160 in FIG. 10A. If coin 160 is of diameter substantially smaller than that of an Eisenhower silver dollar, then it will fall between deflector 161 and coin cam 164 and directly down and out of reject outlet 184 formed between left side wall 115 and dividing pin 182. Similarly, of coin 160 is of diameter substantially greater than that of an Eisenhower silver dollar, it will not be able to enter inlet 146. For coin 160 of diameter comparable to that of an Eisenhower silver dollar, the lower end of deflector 161 and cam 164 are simultaneously engaged, and coin 160 must pivot deflector 161 (thereby pulling connecting rod 205 against the attraction of magnet 207) to pass by deflector 161. Consequently, if coin 160 is substantially ligher than an Eisenhower silver dollar, it will be stopped by deflector 161 and must wait for a second coin 160 to enter inlet 146 so that the combined weights of the two coins will be sufficient to deflect deflector 161 although lock out 215 will be activated, as described below. Note that deflector 161 provides a fairly strong deflection of coin 160 to cam 164 and braking because the attraction of connecting rod 161 to magnet 207 is greatest at no deflection. This initial braking is, of course, the opposite of the first preferred embodiment which braked only after coin 60 had turned wheel 18 to engage brake 17 and thereby permitted light coin 60 to pass through. However, this initial deflection and braking by deflector 161 helps prevent heavy spurious coins, such as lead washers of diameter slightly less than that of an Eisenhower silver dollar, from snagging pin 166, activating carrier 118, as described below, and carrying over to accept outlet 172 without ever engaging cam 164.

Coin 160, after deflecting deflector 161, engages pin 166 while still engaging cam 164. The momentum of coin 160 now rotates carrier 118 (analogous to rotation of wheel 18) with coin 160 held between pin 166 and cam 164 (analogous to being held between pin 66 and cam 64). As with cam 64 of the first embodiment, cam 164 is of variable radius so coins 160 of diameter slightly less than that of an Eisenhower silver dollar will fall forward off pin 166 and out reject outlet 184, whereas coins of diameter slightly greater cannot pass between pin 166 and cam 164 when carrier 118 reaches its maximum rotation position (pin 166 is stopped by the end of slot 225 in front plate 112) and fall backwards off pin 166 and out reject outlet 184. Of course, correct diameter coins 160 ride on pin 166 to carrier 118's maximum rotation position and the continue forward off of pin 166 and out accept outlet 172. This operation parallels that of the first embodiment except that carrier 118 is external to the space between front plate 112 and back plate 114 with only pin 166 projecting through slot 225 into this space, whereas in the first embodiment wheel 18, along with pin 66, is totally inside the space between front plate 12 and back plate 14.

Additionally, carrier 118 has counterweight 174 (analogous to counterweight 74 of wheel 18) to return carrier 118 to the initial position shown in FIG. 10A after coin 160 has passed through and also ferrous block 209 which is attracted by magnet 211 and provides braking of coin 160 when it first engages pin 166. This adds to the braking by deflector 161 and insures that light coins have time to fall forward off of pin 166 and still exit reject outlet 184. An Eisenhower silver dollar will have sufficient momentum, despite the braking, to rapidly rotate carrier 118 and thereby stay on pin 166 sufficiently long to carry over to accept outlet 172.

Annulus catcher 201 is conveniently made of stiff wire which is held by block 227 but is free to pivot in it. One end of annulus catcher 201 holds weight 203 and opposite end 229 projects into the space between front plate 112 and back plate 114 (see FIGS. 20A, D, and E). Annulus catcher 201 operates as follows: with no coins in apparatus 110, weight 203 pulls annulus catcher 201 into the vertical position shown in FIG. 10E with end 229 projecting into the space between front plate 112 and back plate 114. When coin 166 enters inlet 146 and falls as described above, it hits end 229 and deflects it down and out of the space between plates 112 and 114 in the direction of arrow 231 in FIG. 10E. This causes weight 203 to be deflected in the direction of arrow 233, and gravity acting on weight 203 thus provides a restoring force so that end 229 slips across the face of coin 160 as it falls and rides on pin 166. For coin 160 with a central bore (e.g., a washer), end 229 will re-enter the space between plates 112 and 114 as the bore passes and will be deflected a second time by the edge of the bore. This second deflection gives rise to a reaction force on coin 160 generally in the up and left direction in FIG. 10A; that is, to help coin 160 fall backwards off pin 166 and into reject outlet 184. Note that the first deflection may occur prior to coin 160 engaging pin 166: lower coin 160 in FIG. 10A has just deflected end 229 but not yet engaged pin 166. So the first deflection is similar to the braking of deflector 161.

Magnets 123 and 124 pull iron coins 160 backwards off pin 166 analogous to magnets 20, 22, 23, and 24 in apparatus 10. Magnet 123 provides an initial slowing, and magnet 124 provides the pull off pin 166. Use of two magnets positioned as show in FIG. 10A rather than a single stronger magnet avoids the problem of light iron coins 160 sticking to the magnet by smoothing out the magnetic field.

Synchronous coin lock out 215 is conveniently a single piece of stiff wire with a top portion 235 curved to fit through slot 237 in back plate 114 (see FIG. 10F) and a bottom portion 239 bent to fit through hole 241 in back plate 114. Lock out 215 is pivotally held block 243 on back plate 114. As shown in FIG. 10F, with no coin in apparatus 110 lock out 215 rests with top portion 235 against front plate 112 and bottom portion 239 not penetrating the space between plates 112 and 114 because top portion 235 is larger than bottom portion 239 and thus gravity provides a net counterclockwise (in FIG. 10F) torque about the pivot in block 243. When coin 160 enters apparatus and begins to fall it deflects top portion 235 in the direction of arrow 217 and out of the space between plates 112 and 114. This causes bottom portion 239 to enter the space between plates 112 and 114 and abut front plate 112. In this position the larger size of top portion 235 still provides a net counterclockwise torque despite the tilt of lock out 215, and this is a restoring force so once coin 160 drops past top portion 235 (somewhat below lower coin 160 in FIG. 10A) lock out 215 returns to its initial position and bottom portion 239 withdraws from the space between plates 112 and 114 and does not affect the motion of coin 160. However, in the case of a second coin 160 inserted to drive out a first light coin 160 held by deflector 161 or pin 166 and unable to rotate carrier 118, lock out 215 operates to prevent first light coin 160 from carrying over to accept outlet 172 because second coin 160 will be deflecting top portion 235 so bottom portion 239 will project into the space between plates 112 and 114 and thereby block accept outlet 172 so that first light coin 160 will fall backwards off pin 166 and into reject outlet 184.

Although a particular embodiment of the invention has been shown and described in full here, there is no intention to thereby limit the invention to the details of such embodiments. On the contrary, the intention is to cover all modifications, alternatives, embodiments, usages and equivalents of the present invention as fall within the spirit and scope of the specification and appended claims.

What is claimed is:

1. A scavenger free coin acceptor for delivering coins to adjacent delivery chuts, one reject and one accept, comprising, in combination, an enclosed housing with opposed parallel plates, and one front and one rear, a coin insert slot in an upper portion of said housing, a coin path having a thin coin beveled track sloping downwardly and rearwardly toward the rear plate and in open communication with said slot, a coin carrier rotatably mounted within the housing about an axis, a cam in the housing mounted with regard to the carrier and having a runway defining surface and coin path defined by a second beveled track, coin engaging means on the carrier, a counter weight on the carrier opposed to the coin engaging means heavy enough to stop the rotation of the carrier above the reject chute when a lighter than accept table coin is tested, said runway progressively opening the distance between the coin engaging means and the runway defining surface between the four o'clock and six o'clock position, a divider at a lower portion of the housing defining an accept and reject chute.

and stop means on the carrier to terminate its rotation by a falling coin at a point where said coin is proximate the divider, whereby a lighter than acceptable coin will drop to the reject chute before passing the six o'clock position.

2. The coin acceptor of claim 1, in which the cam in the housing is replaceable to use a different size cam thereby accommodating a different size coin within the same housing and with the same components.

3. A coin acceptor for accepting or rejecting; testing the diameter, thickness, and mass of a coin and directing the same to adjacent accept and reject chutes comprising, in combination, an enclosed housing having a front and back plate, a coin insert slot in an upper portion of said housing, a coin path in open communication with said slot having a beveled track, a coin carrier rotatably mounted within the housing about an axis, a cam in the housing mounted with regard to the carrier and having a runway defining surface and coin path defined by a second beveled track, said runway defining surface being beveled inwardly and downwardly toward the back plate for a thin coin to drop into, thereby reducing its effective diameter, coin engaging means on the carrier, said cam opening the distance between its surface and the coin engaging means between the four o'clock and six o'clock positions, thereby dropping a low mass coin before the six o'clock position is reached but retaining a proper diameter and mass coin to pass the six o'clock position, a divider at a lower portion of the housing defining an accept and reject chute, and stop means for the carrier to terminate its rotation by a falling coin at a point where said coin is proximate the divider.

4. The coin acceptor of claim 3, in which the cam in the housing is replaceable to use a different cam size to accommodate different coins.

5. A coin acceptor having an anti-penny cheat mechanism comprising, in combination, a housing, a coin insert slot in an upper portion of said housing, a coin path in open communication with said slot, a coin carrier rotatably mounted within the housing about an axis, a cam in the housing mounted with regard to the carrier and having a runway defining surface and coin path, coin engaging means on the carrier, a divider at a lower portion of the housing defining an accept and reject chute, stop means on the carrier to terminate its rotation by a falling coin at a point where said coin is proximate the divider, a coin lever engaged by a backed up penny so that the end of the lever engages the stop on the carrier to prevent coin passage, and a pin extending from the carrier which, in the stopped position, blocks another backed up penny from entering the accept chute.

6. In the coin acceptor of claim 5, a replaceable cam which permits different coin sizing in the same housing and same environment with the same anti-penny mechanism.

* * * * *